US010005984B2

(12) United States Patent
Hunt et al.

(10) Patent No.: US 10,005,984 B2
(45) Date of Patent: Jun. 26, 2018

(54) USE OF NONIONICS AS RHEOLOGY MODIFIERS IN LIQUID CLEANING SOLUTIONS

(71) Applicant: ECOLAB USA INC., Saint Paul, MN (US)

(72) Inventors: Clinton Hunt, Lakeville, MN (US); Terrence P. Everson, Eagan, MN (US); Erin Jane Dahlquist, West St. Paul, MN (US); Paul J. Prew, Eagan, MN (US); Bruce White, Hugo, MN (US)

(73) Assignee: Ecolab USA Inc., Saint Paul, MN (US)

( * ) Notice: Subject to any disclaimer, the term of this patent is extended or adjusted under 35 U.S.C. 154(b) by 48 days.

(21) Appl. No.: 15/061,499

(22) Filed: Mar. 4, 2016

(65) Prior Publication Data

US 2017/0022449 A1 Jan. 26, 2017

Related U.S. Application Data

(63) Continuation of application No. 13/927,330, filed on Jun. 26, 2013, now Pat. No. 9,309,485.

(51) Int. Cl.

| | |
|---|---|
| ***C11D 1/83*** | (2006.01) |
| ***C11D 1/22*** | (2006.01) |
| ***C11D 1/72*** | (2006.01) |
| ***C11D 3/20*** | (2006.01) |
| ***C11D 3/37*** | (2006.01) |

(Continued)

(52) U.S. Cl.

CPC ..... *C11D 1/83* (2013.01); *C11D 1/22* (2013.01); *C11D 1/72* (2013.01); *C11D 3/2006* (2013.01); *C11D 3/2041* (2013.01); *C11D 3/2068* (2013.01); *C11D 3/3723* (2013.01); *C11D 11/0023* (2013.01); *C11D 17/003* (2013.01)

(58) Field of Classification Search

CPC ..... C11D 1/83; C11D 1/75; C11D 3/3947
USPC ..... 510/235
See application file for complete search history.

(56) References Cited

U.S. PATENT DOCUMENTS

| | | | |
|---|---|---|---|
| 4,102,823 | A | 7/1978 | Matheson |
| 4,203,872 | A | 5/1980 | Flanagan |
| 4,244,840 | A | 1/1981 | Straw |

(Continued)

FOREIGN PATENT DOCUMENTS

| | | |
|---|---|---|
| AT | 187760 | 11/1956 |
| AT | 307183 | 7/1970 |

(Continued)

OTHER PUBLICATIONS

Korean Intellectual Property Office, "International Search Report and the Written Opinion", issued in connection to International Application No. PCT/US2014/041373, 15 pages, dated Oct. 1, 2014.

(Continued)

*Primary Examiner* — Gregory Webb
(74) *Attorney, Agent, or Firm* — McKee, Voorhees & Sease, PLC

(57) ABSTRACT

The invention involves liquid cleaning compositions that are cocamide DEA free. According to the invention, nonionic surfactants can be used as rheology modifiers in combination with various coupling agents to provide an environmentally friendly alternative for traditional liquid cleaning compositions that rely on cocamide DEA thickening agents.

20 Claims, 2 Drawing Sheets

(51) Int. Cl.
*C11D 17/00* (2006.01)
*C11D 11/00* (2006.01)

(56) References Cited

U.S. PATENT DOCUMENTS

| | | | | |
|---|---|---|---|---|
| 4,690,779 | A | 9/1987 | Baker et al. | |
| 5,454,984 | A | 10/1995 | Graubart et al. | |
| 5,522,942 | A | 6/1996 | Graubart | |
| 5,851,981 | A | 12/1998 | Choy et al. | |
| 5,977,042 | A | 11/1999 | Hernandez et al. | |
| 6,013,615 | A | 1/2000 | Zhou et al. | |
| 6,046,152 | A | 4/2000 | Vinson et al. | |
| 6,214,784 | B1 | 4/2001 | Robbins et al. | |
| 6,242,401 | B1 | 6/2001 | Durbut et al. | |
| 6,376,455 | B1 | 4/2002 | Friedli et al. | |
| 6,387,871 | B2 | 5/2002 | Faber | |
| 6,596,681 | B1 | 7/2003 | Mahieu et al. | |
| 6,723,692 | B2 | 4/2004 | Foley et al. | |
| 6,750,190 | B2 | 6/2004 | Colurciello et al. | |
| 6,861,397 | B2 | 3/2005 | Seitz, Jr. et al. | |
| 6,897,188 | B2 | 5/2005 | Gohl et al. | |
| 6,933,267 | B2 | 8/2005 | Colurciello et al. | |
| 7,307,055 | B2 | 12/2007 | Cook et al. | |
| 7,910,532 | B2 | 3/2011 | Johnson et al. | |
| 8,278,259 | B2 | 10/2012 | Shamayeli et al. | |
| 8,329,630 | B2 | 12/2012 | Finison et al. | |
| 8,394,751 | B2 | 3/2013 | Hawes, III et al. | |
| 8,455,551 | B2 | 6/2013 | Heisig et al. | |
| 2004/0224867 | A1 | 11/2004 | Colurciello et al. | |
| 2008/0234170 | A1 | 9/2008 | Diet et al. | |
| 2009/0105113 | A1 | 4/2009 | Tuzi et al. | |
| 2010/0197518 | A1 | 8/2010 | Xu et al. | |
| 2010/0227930 | A1 | 9/2010 | Lusignan | |
| 2010/0323942 | A1* | 12/2010 | Evers | C11D 3/33 510/236 |
| 2010/2323946 | | 12/2010 | Connors et al. | |
| 2011/0152158 | A1* | 6/2011 | Bettiol | C11D 1/83 510/237 |
| 2011/0190187 | A1 | 8/2011 | Hawes, III et al. | |
| 2011/0271979 | A1 | 11/2011 | Mondin et al. | |
| 2012/0034287 | A1 | 2/2012 | Napolitano et al. | |
| 2012/0225948 | A1 | 9/2012 | Heisig et al. | |

FOREIGN PATENT DOCUMENTS

| | | | |
|---|---|---|---|
| AT | 287939 | | 2/1971 |
| AU | 672678 | | 10/1994 |
| BR | 94015210 | A | 12/1994 |
| CA | 2724792 | A1 | 11/2009 |
| CA | 2683421 | A1 | 9/2010 |
| CN | 1093876 | C | 11/2002 |
| DE | 60108549 | T2 | 1/2006 |
| EP | 0630965 | A1 | 12/1994 |
| EP | 1245668 | A2 | 10/2002 |
| EP | 1245668 | A3 | 10/2002 |
| EP | 2264136 | B1 | 12/2010 |
| EP | 2264138 | B1 | 12/2010 |
| FR | 2267369 | | 11/1975 |
| JP | 20033200 | A | 1/2003 |
| TW | 546377 | | 8/2003 |
| WO | 9739089 | A1 | 10/1997 |
| WO | 0248299 | A1 | 6/2002 |
| WO | 2009143091 | A1 | 11/2009 |
| WO | 2009143513 | A1 | 11/2009 |
| WO | 2012018654 | A1 | 2/2012 |
| WO | 2012121964 | A1 | 9/2012 |
| WO | 2013064315 | A1 | 5/2013 |

OTHER PUBLICATIONS

Bozetine, T. et al., "Optimization of an Alkylpolyglucoside-Based Dishwashing Detergent Formulation", J. Surfact. Deterg. (2008), 11:299-305.

Bruschweiler, Dr. H., "Flussigwaschmittel", Tenside Detergents, v. 23, n. 1, p. 7-11, Jan.-Feb. 1986; German: ISSN:00403490.

Filipovic-Vincekovic, Dr. N., et al., "Surfactants in Liquid Decontamination Proceses", Tenside Surfactants Detergents, 24 (1987) 3, p. 167-172, ISSN:09323414.

Jadidi, Nazanin et al., "Synergism and Performance Optimization in Liquid Detergents Containing Binary Mixtures of Anionic-Cationic Surfactants", J. Surfact. Deterg., (2013), 16:115-121.

Malihi, F.B., et al., "Evaluation of Physico-Chemical Interactions between Linear Alkylbenzene Sulfonate (LAS) and Alcohol Ethoxylates", Tenside Suf. Det. 48 (2011) 5, p. 395-399.

Raney, Kirk H., "Optimization of Nonionic /Anionic Surfactant Blends for Enhanced Oily Soil Removal", Journal of the Americal Oil Chemists' Society, vol. 68, No. 7 (Jul. 1991), pp. 525-531.

Rojoranun, Sureeporn, et al., "Mechanistic Studies of Particulate Soil Detergency: I. Hydrophonic Soil Removal", J. Surfact. Deterg. (2012), 15:277-289.

Rojoranun, Sureeporn, et al., "Mechanistic Studies of Particulate Soil Detergency: II. Hydrophonic Soil Removal", J. Surfact. Deterg. (2012), 15:663-677.

Tenside Surfactants, Detergents-Basf, 1 page (v. 24, n. 3, pp. 167-172), May-Jun. 1987, USSBL 09323414.

Zaid, T. Ahmed, et al., "Response Surface Methodology as an approach to the Optimization of a Dishwashing Detergent", Tenside, Surfactants, Detergents. 44 (2007) 2, pp. 94-101.

* cited by examiner

USE OF NONIONICS AS RHEOLOGY MODIFIERS IN LIQUID CLEANING SOLUTIONS

CROSS-REFERENCE TO RELATED APPLICATION

This application is a Continuation Application of U.S. Ser. No. 13/927,330, filed Jun. 26, 2013, entitled "Novel Use of Nonionics as Rheology Modifiers in Liquid Cleaning Solutions", which is herein incorporated by reference in its entirety.

FIELD OF THE INVENTION

The present invention relates to novel liquid cleaning compositions which rely on specific combinations of nonionic surfactants and coupling agents as rheology modifiers. Such rheology modifiers can be used as a replacement for traditional foaming agents which are under regulatory pressure and the invention relates to novel cleaning compositions such as pot and pan soaking compositions, dishwashing compositions, food and beverage foaming cleaners, vehicle cleaning and the like. The invention further relates to methods of making these compositions, and to methods employing these compositions.

BACKGROUND OF THE INVENTION

Many cleaning compositions include a rheology modifying/foaming agent to increase contact time on surfaces to be cleaned. The most widely used foaming agent is cocamide DEA, or cocamide diethanolamine, a diethanolamide made by reacting a mixture of fatty acids from coconut oils (cocamide) with diethanolamine. The agent may also been known as lauramide diethanolamine, Coco Diethanolamide, coconut oil amide of diethanolamine, Lauramide DEA, Lauric diethanolamide, Lauroyl diethanolamide, and Lauryl diethanolamide.

It is a viscous liquid and the chemical formula is $CH_3(CH_2)_nC(=O)N(CH_2CH_2OH)_2$, where n can vary depending on the source of fatty acids. Coconut oil contains about 50% of lauric acid, thus the formula of cocamide can be written as $CH_3(CH_2)_{10}CONH_2$, though the number of carbon atoms in the chains varies. Cocamide DEA has come under criticism lately and is under regulatory pressure to have it removed from products. It is an allergen that can cause contact dermatitis in individuals who are susceptible to skin allergies. More recently, cocamide DEA has been linked to cancer.

The International Agency for Research on Cancer (IARC) lists coconut oil diethanolamine condensate (cocamide DEA) as an IARC Group 2B carcinogen, which identifies this chemical as possibly carcinogenic to humans. In June 2012, the California Office of Environmental Health Hazard Assessment added Cocamide DEA to the California Proposition 65 (1986) list of chemicals known to cause cancer.

Accordingly it is an object herein to provide a rheology modified cleaning composition with a combination of components that can be used as a replacement for cocamide DEA.

It is yet another object of the invention to provide a cleaning composition that is safe, environmentally friendly and economically feasible.

Other objects, aspects and advantages of this invention will be apparent to one skilled in the art in view of the following disclosure, the drawings, and the appended claims.

SUMMARY OF THE INVENTION

The invention involves liquid cleaning compositions that rely upon nonionic surfactants as rheology modifiers and includes a cleaning composition with one or more nonionic surfactants in combination with coupling agents of an aromatic sulfonate, and a protic solvent, in addition to a salt and water.

According to the invention, nonionic surfactants, such as ethoxylated Guerbet alcohols combined with specific coupling agents provide for a liquid cleaning composition which does not need to rely on the use of cocamide DEA or other regulatory undesirable rheology modifiers. The liquid cleaning compositions include nonionic surfactants that are present in much lower concentration than in traditional cleaning compositions. The amount of nonionic surfactant is generally about 7.5 wt. % or less, preferably 5 wt. % or less and more preferably 2 wt. % or less. Applicants have further found that the nonionic surfactant must be present with coupling agents of an aromatic sulfonate and a protic solvent to provide the appropriate rheology to the composition. Applicants have also found that the salt component should reach at least about 2 wt. % or more.

Additional cleaning components may also be present such as a source of alkalinity, foaming agents, preservatives, and the like.

According to the invention, liquid cleaning compositions are formed with a lower than detersive amount of an nonionic surfactant, typically from about 0.01 wt. % to about 7.5 wt. % in contrast to traditional cleaning compositions which include amounts up to 25 Wt. %. The compositions also include coupling agents, from about 0.01 wt. % to about 10 wt. % each of an aromatic sulfonate coupling agent and a protic solvent coupling agent, with at least about 2 wt. % of salt. Liquid cleaning compositions of the invention demonstrated similar viscosity to traditional cleaning compositions which rely upon cocamide DEA or other traditional viscosity modifiers.

The cleaning compositions of the invention are advantageously formulated to be cocamide DEA free, and phosphate-free, as well as containing only ingredients generally recognized as safe (GRAS) for human use. Cocamide DEA-free, refers to a composition, mixture, or ingredients to which cocamide DEA-containing compounds are not added. Should these compounds be present, for example through contamination of a cocamide DEA-free composition, mixture, or ingredients, the level of the same shall be less than 0.5 wt. %, may be less than 0.1 wt. %, and often less than 0.01 wt. %.

In another aspect, the presently described technology provides a process to prepare a cocamide DEA free liquid cleaning composition. The process can include the steps of adding to an aqueous medium a less than detersive amount of a nonionic surfactant and from about 0.01% wt. % to about 10 wt. % of one or more aromatic sulfonates, and from about 0.01 wt. % to about 10 wt. % of a protic solvent in combination with a minimum level of salt.

A novel cleaning method is also within the invention and involves applying the liquid cleaning mixture to a surface to be cleaned, allowing the composition to remain for a sufficient period of time for cleaning (typically until any foam that is present dissipates) and thereafter rinsing said surface until that said cleaning composition is removed along with soil and debris.

DETAILED DESCRIPTION OF THE INVENTION

Figure 1:
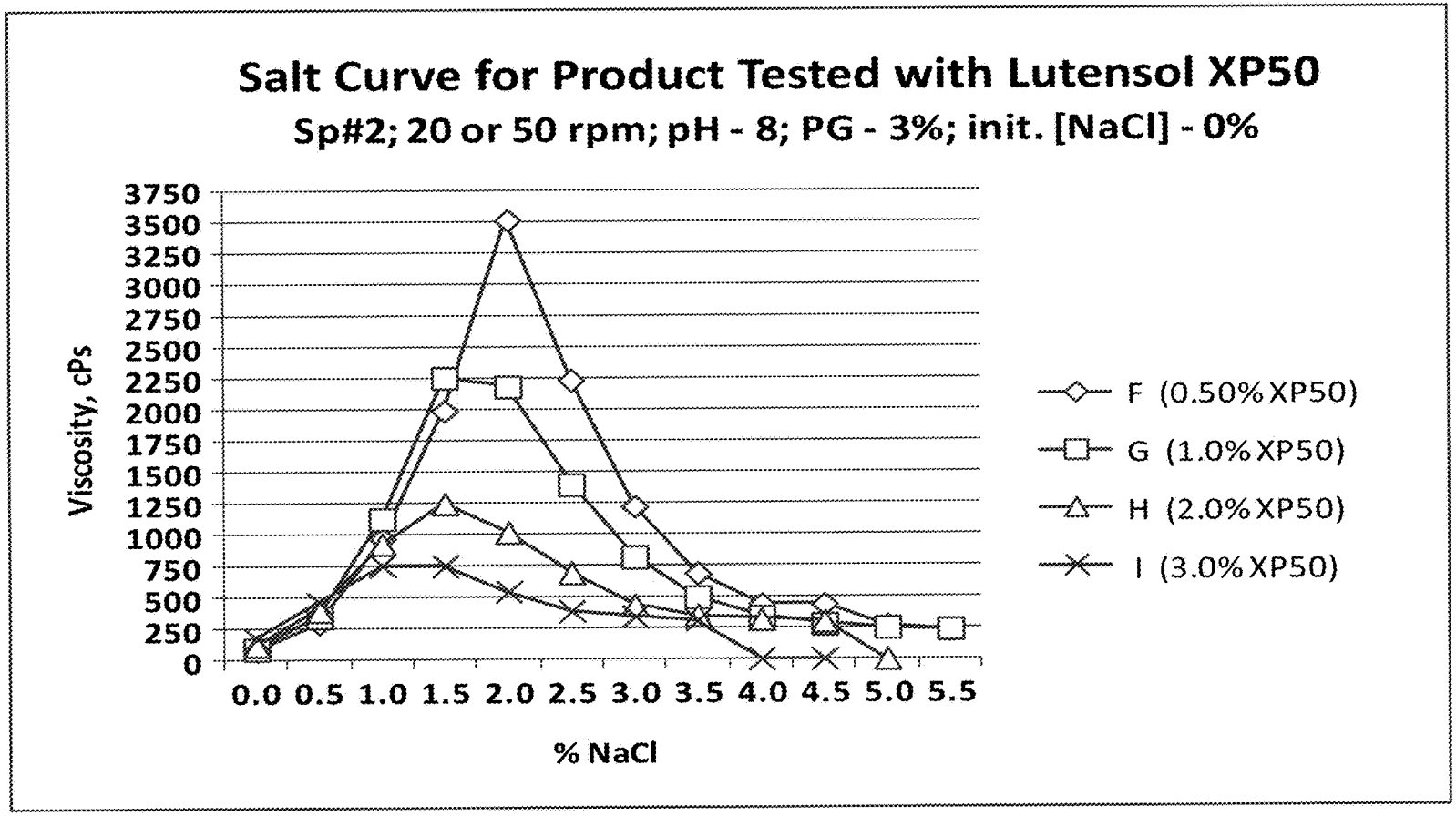
FIG. 1 is salt curve graph for Lutensol XP50.

While the presently described technology will be described in connection with one or more preferred embodiments, it will be understood by those skilled in the art that the technology is not limited to only those particular embodiments. To the contrary, the presently described technology includes all alternatives, modifications, and equivalents as may be included within the spirit and scope of the appended claims.

"Cleaning" means to perform or aid in soil removal, bleaching, microbial population reduction, rinsing, or combination thereof.

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

The term "actives" or "percent actives" or "percent by weight actives" or "actives concentration" are used interchangeably herein and refers to the concentration of those ingredients involved in cleaning expressed as a percentage minus inert ingredients such as water or salts.

As used herein, "weight percent," "wt. %," "percent by weight," "% by weight," and variations thereof refer to the concentration of a substance as the weight of that substance divided by the total weight of the composition and multiplied by 100. It is understood that, as used here, "percent," "%," and the like are intended to be synonymous with "weight percent," "wt. %," etc.

The term "about," as used herein, modifying the quantity of an ingredient in the compositions of the invention or employed in the methods of the invention refers to variation in the numerical quantity that can occur, for example, through typical measuring and liquid handling procedures used for making concentrates or use solutions; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about," the claims include equivalents to the quantities. All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers subsumed within that range (e.g., 1 to 5 includes 1, 1.5, 2, 2.75, 3, 3.80, 4, and 5).

The term "protic" is used herein to describe a solvent that is protogenic under the given conditions. Thus, a "protic" compound or solvent is capable of acting as a proton donor, either strongly or weakly, under the specific conditions. For example, ethanol can be a protic solvent even through it is a weak acid.

The term "commercially acceptable cleaning performance" refers generally to the degree of cleanliness, extent of effort, or both that a typical consumer would expect to achieve or expend when using a cleaning product or cleaning system to address a typical soiling condition on a typical substrate. This degree of cleanliness may, depending on the particular cleaning product and particular substrate, correspond to a general absence of visible soils, or to some lesser degree of cleanliness. For example, a shower cleaner or toilet bowl cleaner would be expected by a typical consumer to achieve an absence of visible soils when used on a moderately soiled but relatively new hard surface, but would not be expected to achieve an absence of visible soils when used on an old hard surface which already bears permanent stains such as heavy calcite deposits or iron discoloration. Cleanliness may be evaluated in a variety of ways depending on the particular cleaning product being used (e.g., ware or laundry detergent, rinse aid, hard surface cleaner, vehicular wash or rinse agent, or the like) and the particular hard or soft surface being cleaned (e.g., ware, laundry, fabrics, vehicles, and the like), and normally may be determined using generally agreed industry standard tests or localized variations of such tests. In the absence of such agreed industry standard tests, cleanliness may be evaluated using the test or tests already employed by a manufacturer or seller to evaluate the cleaning performance of its phosphorus-containing cleaning products sold in association with its brand.

The term "substantially similar cleaning performance" refers generally to achievement by a substitute cleaning product or substitute cleaning system of generally the same degree (or at least not a significantly lesser degree) of cleanliness or with generally the same expenditure (or at least not a significantly lesser expenditure) of effort, or both, when using the substitute cleaning product or substitute cleaning system rather than a branded phosphorus-containing cleaning to address a typical soiling condition on a typical substrate. This degree of cleanliness may, depending on the particular cleaning product and particular substrate, correspond to a general absence of visible soils, or to some lesser degree of cleanliness, as explained in the prior paragraph.

The term "improved cleaning performance" refers generally to achievement by a substitute cleaning product or substitute cleaning system of a generally greater degree of cleanliness or with generally a reduced expenditure of effort, or both, when using the substitute cleaning product or substitute cleaning system rather than a branded phosphorus-containing cleaning product to address a typical soiling condition on a typical substrate. This degree of cleanliness may, depending on the particular cleaning product and particular substrate, correspond to a general absence of visible soils, or to some lesser degree of cleanliness, as explained above.

The terms "include" and "including" when used in reference to a list of materials refer to but are not limited to the materials so listed.

The term "water soluble" refers to a compound that can be dissolved in water at a concentration of more than 1 wt. %. The terms "sparingly soluble" or "sparingly water soluble" refer to a compound that can be dissolved in water only to a concentration of 0.1 to 1.0 wt. %. The term "water insoluble" refers to a compound that can be dissolved in water only to a concentration of less than 0.1 wt. %.

The term "substantially free" may refer to any component that the composition of the invention lacks or mostly lacks. When referring to "substantially free" it is intended that the component is not intentionally added to compositions of the invention. Use of the term "substantially free" of a component allows for trace amounts of that component to be included in compositions of the invention because they are present in another component. However, it is recognized that only trace or de minimus amounts of a component will be allowed when the composition is said to be "substantially free" of that component. Moreover, the term if a composition is said to be "substantially free" of a component, if the component is present in trace or de minimus amounts it is understood that it will not affect the effectiveness of the composition. It is understood that if an ingredient is not expressly included herein or its possible inclusion is not stated herein, the invention composition may be substantially free of that ingredient. Likewise, the express inclusion of an ingredient allows for its express exclusion thereby allowing a composition to be substantially free of that expressly stated ingredient.

As used herein, the term "ware" refers to items such as eating and cooking utensils, dishes, and other hard surfaces such as showers, sinks, toilets, bathtubs, countertops, windows, mirrors, transportation vehicles, and floors. As used herein, the term "warewashing" refers to washing, cleaning, or rinsing ware. Ware also refers to items made of plastic. Types of plastics that can be cleaned with the compositions according to the invention include but are not limited to, those that include polycarbonate polymers (PC), acrilonitrile-butadiene-styrene polymers (ABS), and polysulfone polymers (PS). Another exemplary plastic that can be cleaned using the compounds and compositions of the invention include polyethylene terephthalate (PET).

Liquid Cleaning Compositions of the Invention

The invention involves liquid cleaning compositions that rely upon nonionic surfactants as rheology modifiers and includes a cleaning composition with one or more nonionic surfactants in combination with coupling agents of an aromatic sulfonate, and a protic solvent, in addition to a salt and water.

According to the invention, nonionic surfactants, such as ethoxylated Guerbet alcohols combined with specific coupling agents provide for a liquid cleaning composition which does not need to rely on the use of cocamide DEA or other regulatory undesirable rheology modifiers. The cleaning compositions of the invention are advantageously formulated to be cocamide DEA free and phosphate free as well as containing only ingredients generally recognized as safe (GRAS) for human use.

In a preferred embodiment the cleaning composition is cocamide DEA-free. Cocamide DEA-free, refers to a composition, mixture, or ingredients to which cocamide DEA-containing compounds are not added. Should these compounds be present, for example through contamination of a cocamide DEA-free composition, mixture, or ingredients, the level of the same shall be less than 0.5 wt. %, may be less than 0.1 wt. %, and often less than 0.01 wt. %.

According to the invention nonionic surfactants are present in much lower concentration than in traditional cleaning composition are used. The amount of nonionic surfactant is generally about 7.5 wt. % or less, preferably 5 wt. % or less and more preferably 2 wt. % or less. Applicants have further found that the nonionic surfactant must be present with coupling agents of an aromatic sulfonate and a protic solvent can provide the appropriate rheology to the composition. Applicants have also found that the salt component should reach at least about 2 wt. % or more.

Nonionic Surfactant/Rheology Modifier

The liquid compositions of the invention include one or more nonionic surfactants and are generally characterized by the presence of an organic hydrophobic group and an organic hydrophilic group, typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties. Useful nonionic surfactants in the present invention include:

Condensation products of one mole of a saturated or unsaturated, straight or branched chain alcohol having from 6 to 24 carbon atoms with from 3 to 50 moles of ethylene oxide. The alcohol moiety can consist of mixtures of alcohols in the above delineated carbon range or it can consist of an alcohol having a specific number of carbon atoms within this range. Examples of like commercial surfactant are available under the trade names Neodol® manufactured by Shell Chemical Co. and Alfonic® manufactured by Vista Chemical Co. This includes Guerbet alcohols such as those sold under the Lutensol name from BASF.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention. All of these ester moieties have one or more reactive hydrogen sites on their molecule which can undergo further acylation or ethylene oxide (alkoxide) addition to control the hydrophilicity of these substances.

The ethoxylated $C_6$-$C_{18}$ fatty alcohols and $C_6$-$C_{18}$ mixed ethoxylated and propoxylated fatty alcohols are suitable surfactants for use in the present compositions, particularly those that are water soluble. Suitable ethoxylated fatty alcohols include the $C_{10}$-$C_{18}$ is ethoxylated fatty alcohols with a degree of ethoxylation of from 3 to 50.

Suitable nonionic alkylpolysaccharide surfactants, particularly for use in the present compositions include those disclosed in U.S. Pat. No. 4,565,647, Llenado, issued Jan. 21, 1986. These surfactants include a hydrophobic group containing from 6 to 30 carbon atoms and a polysaccharide, e.g., a polyglycoside, hydrophilic group containing from 1.3 to 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside). The intersaccharide bonds can be, e.g., between the one position of the additional saccharide units and the 2-, 3-, 4-, and/or 6-positions on the preceding saccharide units.

The treatise Nonionic Surfactants, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

In some embodiments the non-ionic surfactant is a Guerbet alcohol ethoxylate of the formula $R^1$—$(OC_2H_4)_n$—(OH), wherein $R^1$ is a branched $C_9$-$C_{20}$ alkyl group and n is from 2 to 10.

In a preferred embodiment the Guerbet alcohol ethoxylate being used in the liquid surfactant composition is a Guerbet alcohol ethoxlyate of the formula $R^1$—$(OC_2H_4)_n$—(OH), This includes a Guerbet alcohol ethoxylate where $R^1$a branched $C_{10}$ to $C_{18}$ alkyl group and n is from 5 to 10, preferably 7 to 9 and also ones wherein $R^1$ is $C_8$ to $C_{12}$ branched alkyl group, preferably branched $C_{10}$ to alkyl group and n is 2 to 4, preferably 3. Such Guerbet alcohols are available, for example, under the trade name Lutensol from BASF or Eutanol G from Cognis.

The Guerbet reaction is a self-condensation of alcohols by which alcohols having branched alkyl chains are produced. The reaction sequence is related to the Aldol condensation and occurs at high temperatures under catalytic conditions. The product is a branched alcohol with twice the molecular weight of the reactant minus a mole of water. The reaction proceeds by a number of sequential reaction steps. At first the alcohol is oxidized to an aldehyde. Then Aldol condensation takes place after proton extraction. Thereafter the aldol product is dehydrated and the hydrogenation of the allylic aldehyde takes place.

These products are called Guerbet alcohols and are further reacted to the nonionic alkoxylated guerbet alcohols by alkoxylation with i.e. ethylene oxide, butylene oxide, propylene oxide and the like. The ethoxylated guerbet alcohols have a lower solubility in water compared to the linear ethoxylated alcohols with the same number of carbon atoms. Therefore the exchange of linear fatty alcohols by branched fatty alcohols makes it necessary to use good solubilizers which are able to keep the guerbet alcohol in solution and the resulting emulsion stable even over a longer storage time.

In certain embodiments the surfactant compositions include one or more other suitable polymers which may be used in the surfactant compositions of the invention and include alkyl aryl sulfonates. Suitable alkyl aryl sulfonates that can be used in the cleaning composition can have an alkyl group that contains 6 to 24 carbon atoms and the aryl group can be at least one of benzene, toluene, and xylene. A suitable alkyl aryl sulfonate includes linear alkyl benzene sulfonate. A suitable linear alkyl benzene sulfonate includes linear dodecyl benzyl sulfonate that can be provided as the sulfonic acid that is neutralized to form the sulfonate. Additional suitable alkyl aryl sulfonates include xylene sulfonate and cumene sulfonate.

Suitable alkane sulfonates that can be used in the cleaning composition can have an alkane group having 6 to 24 carbon atoms. Suitable alkane sulfonates that can be used include secondary alkane sulfonates. A suitable secondary alkane sulfonate includes sodium $C_{14}$-$C_{17}$ secondary alkyl sulfonate commercially available as Hostapur SAS from Clariant.

In a preferred embodiment the surfactant system includes one or more of the following: a polyalkylene glycol, an ethoxylated alcohol, a polyalkylene glycol ether ethoxylate, an alkyl glucoside, an alkyl aryl sulfonate, an alkyl dimethyl amine oxide, and an alpha olefin sulfonate. In a more preferred embodiment the invention includes a polyethylene glycol, a linear C9-C11 alcohol ethoxylate, (preferably with 5-6 moles of ethoxylation, a Guerbet alcohol alkoxylate, such as those sold under the trade name Lutensol® (ex. BASF AG), available in a variety of grades, preferably Lutensol XP-50, a hexyl alkyl glucoside, a linear alkyl benzene sulfonate, a lauryl dimethyl amine oxide, and an alpha olefin sulfonate.

The surfactant system may be used alone as a booster, comprising surfactant and a carrier, (such as water) or may comprise from about 0.01 weight percent to about 7.5 weight percent of actives, preferably about 0.05 weight percent to about 5 weight percent, and more preferably about 0.1 weight percent to about 2.0 weight percent actives as part of a cleaning composition.

Aromatic Sulfonate Coupling Agent

Suitable alkyl aryl sulfonates that can be used in the cleaning composition can have an alkyl group that contains 6 to 24 carbon atoms and the aryl group can be at least one of benzene, toluene, and xylene. A suitable alkyl aryl sulfonate includes linear alkyl benzene sulfonate. A suitable linear alkyl benzene sulfonate includes linear dodecyl benzyl sulfonate that can be provided as an acid that is neutralized to form the sulfonate. Additional suitable alkyl aryl sulfonates include xylene sulfonate and cumene sulfonate.

Aromatic sulfonates such as the alkyl benzene sulfonates (e.g. xylene sulfonates) or naphthalene sulfonates, aryl or alkaryl phosphate esters or their alkoxylated analogues having 1 to about 40 ethylene, propylene or butylene oxide units or mixtures thereof are also examples of useful aromatic sulfonates.

The aromatic sulfonate is present in the composition in an amount of from about 0.01 wt. % to about 10 wt. %, preferably from about 0.05 wt. % to about 7.5 wt. % and more preferably from about 0.1 wt. % to about 5 wt. %.

Protic Solvent Coupling Agent

Protic solvents include lower alkanols, lower alkyl ethers, glycols, aryl glycol ethers and lower alkyl glycol ethers. These materials are colorless liquids with mild pleasant odors, are excellent solvents and coupling agents and may be miscible with liquid cleaning compositions of the invention. Examples of useful solvents include methanol, ethanol, propanol, isopropanol and butanol, isobutanol, ethylene glycol, diethylene glycol, triethylene glycol, propylene glycol, dipropylene glycol, mixed ethylene-propylene glycol ethers, ethylene glycol phenyl ether, and propylene glycol phenyl ether. Substantially water soluble glycol ether solvents include propylene glycol methyl ether, propylene glycol propyl ether, dipropylene glycol methyl ether, tripropylene glycol methyl ether, ethylene glycol butyl ether, diethylene glycol methyl ether, diethylene glycol butyl ether, ethylene glycol dimethyl ether, ethylene glycol propyl ether, diethylene glycol ethyl ether, triethylene glycol methyl ether, triethylene glycol ethyl ether, triethylene glycol butyl ether, and others. "Substantially water soluble" solvents are defined as being infinitely or 100% soluble by weight in water at 25° C. "Substantially water insoluble" glycol ether solvents include propylene glycol butyl ether, dipropylene glycol butyl ether, dipropylene glycol propyl ether, tripropylene glycol butyl ether, dipropylene glycol dimethyl ether, propylene glycol phenyl ether, ethylene glycol hexyl ether, diethylene glycol hexyl ether, ethylene glycol phenyl ether, diethylene glycol phenyl ether, and others. "Substantially water insoluble" solvents are defined as 53% by weight or less of solvent is soluble in water at 25 degrees C. The protic solvent is present in the composition in an amount of from about 0.01 wt. % to about 10 wt. %, preferably from about 0.05 wt. % to about 7.5 wt. % and more preferably from about 0.1 wt. % to about 5 wt. %.

Salt

The invention also includes a neutral salt. Most neutral salts consist of cations including Na+ K+ Rb+ Cs+ Mg2+ Ca2+ Sr2+ Ba2+ and anions, such as Cl— Br— I—, ClO4- BrO4- ClO3- and NO3- These ions have little tendency to react with water. Thus, salts consisting of these ions are neutral salts. For example: NaCl, $KNO_3$, $CaBr_2$, $CsClO_4$ are neutral salts. Applicants have found that the salt component should be present in at least about 2 wt. % actives. The salt component can, however, be present in an amount from about 0.01 wt. % to about 8 wt. % preferably from about 0.05 wt. % to about 6.5 wt. % and more preferably from about 0.1 wt. % to about 5 wt. %.

Foam Promoting/Stabilizing Agent

In some embodiments the composition can include various foam promotion or stabilizing agents. Foam stabilizing agents can include one or more anionic surfactants and/or certain positively charged polymers. The anionic surfactant if present may also play a detersive role in the composition. The entirety of the foam promotion/stabilization component can be present in an amount from about 4 wt. % to about 65 wt. % preferably from about 6.5 wt. % to about 70 wt. % and more preferably from about 9 wt. % to about 75 wt. %.

Anionic Surfactants

Certain embodiments of the invention contemplate the use of one or more anionic surfactants which electrostatically interact or ionically interact with the positively charged polymer to enhance foam stability. Anionic surfactants are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

As those skilled in the art understand, anionics are excellent detersive surfactants and are therefore traditionally favored additions to heavy duty detergent compositions. Generally, anionics have high foam profiles which are useful for the present foaming cleaning compositions. Anionic surface active compounds are useful to impart special chemical or physical properties other than detergency within the composition.

The majority of large volume commercial anionic surfactants can be subdivided into five major chemical classes and additional sub-groups known to those of skill in the art and described in "Surfactant Encyclopedia," Cosmetics & Toiletries, Vol. 104 (2) 71-86 (1989).

The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. A particularly preferred anionic surfactant is alpha olefin sulfonate. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like. The fifth class includes sulfuric acid esters (and salts), such as alkyl ether sulfates, alkyl sulfates, and the like. A particularly preferred anionic surfactant is sodium laurel ether sulfate.

Anionic sulfate surfactants suitable for use in the present compositions include the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl) glucamine sulfates, and sulfates of alkylpolysaccharides such as the sulfates of alkylpolyglucoside (the nonionic nonsulfated compounds being described herein). Ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Examples of suitable synthetic, water soluble anionic detergent compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from 5 to 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants suitable for use in the present compositions include the alkyl ethoxy carboxylates, the alkyl polyethoxy polycarboxylate surfactants and the soaps (e.g. alkyl carboxyls). Secondary soap surfactants (e.g. alkyl carboxyl surfactants) useful in the present compositions include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic detergents suitable for use in the present compositions include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy) ether sulfates and aromatic poly(ethyleneoxy)sulfates such as the sulfates or condensation products of ethylene oxide and nonyl phenol (usually having 1 to 6 oxyethylene groups per molecule). Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

The one or more anionic surfactants/foam stabilizers are present in the composition in an amount which can range typically from about 5 wt. % to about 50 wt. % of the cleaning composition. In a preferred embodiment, about 7.5 wt. % to about 45 wt. % and more preferably from about 10 wt. % to about 40 wt. %.

Positively Charged Polymer

Certain embodiments of the invention also include the use of positively charged polymers such as polyethyleneimine (PEI) and its derivatives including ethoxylated (PEI) polymers, polyamines, polyquats, polyglycerol quats, and other PEI derivatives, their salts or mixtures may use in the compositions of the invention for foam stabilization. PEI is a polymeric amine or a polyamine, and include, polyethyleneimine compounds (PEI) and/or its derivatives. Polyethyleneimines may include primary, secondary or tertiary amine compounds. The polyethyleneimine compounds and/or its derivatives may include linear and/or branched polyethyleneimines. Still further, polyethyleneimines and/or its derivatives can vary significantly in molecular weight, topology and shape, including for example linear, branched or comb-like structures as a result of ring-opening polymerization of the ethylenimine. See Angelescu et al., *Langmuir,* 27, 9961-9971 (2011), which is incorporated herein by reference in its entirety. According to an aspect of the invention, the bleach activator may be a linear and/or branched polyethyleneimine.

Linear polyethyleneimines are made by the cationic polymerization of oxazoline and oxazine derivatives. Methods for preparing linear PEIs are more fully described in Advances in Polymer Science, Vol. 102, pgs. 171-188, 1992 (references 6-31) which is incorporated in its entirety herein by reference. Polyethyleneimines can also be made by the polymerization of aziridine to afford a polymeric amine often containing primary, secondary, and tertiary amine functionality. Commercial preparation of PEIs are generally acid-catalyzed reactions to open the ring of ethyleneimine, also known as aziridine as shown below.

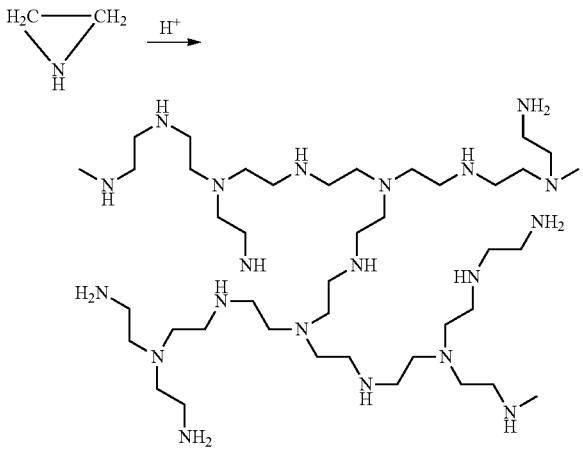

Often the commercial production of ethyleneimine, which is subsequently catalyzed to form PEIs, is prepared through sulfuric acid esterification of ethanolamine, such as shown below:

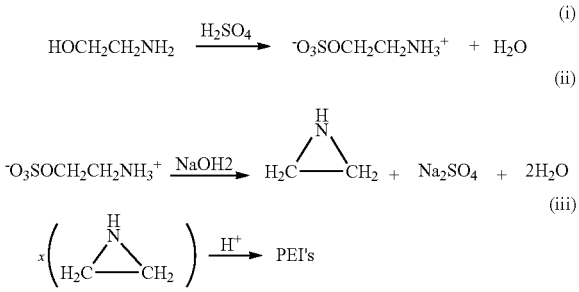

Suitable polyethyleneimine compounds useful in the present invention may contain a mixture of primary, secondary, and tertiary amine substituents. The mixture of primary, secondary, and tertiary amine substituents may be in any ratio, including for example in the ratio of about 1:1:1 to about 1:2:1 with branching every 3 to 3.5 nitrogen atoms along a chain segment. Alternatively, suitable polyethyleneimine compounds may be primarily one of primary, secondary or tertiary amine substituents.

Exemplary PEI products include multifunctional cationic polyethyleneimines with branched polymer structures according to the following formulas (—($CH_2$—$CH_2$—NH)$_n$—), with a molecular mass of 43.07 (as repeating units). In certain aspects the formula (—($CH_2$—$CH_2$—NH)$_n$—) has a value of n that is at least 10 to $10^5$, and wherein the nitrogen to carbon ratio is 1:2. PEI polymers have the general following polymer structure:

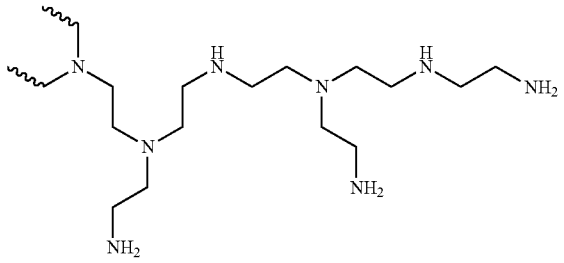

PEI products can also be represented by the following general formula, which may vary according to substitutions, size, molecular weight, branching, and the like:

$$(—NHCH_2CH_2-)_x[—N(CH_2CH_2NH_2)CH_2CH_2-]_y$$

wherein x is an integer that is 1 or greater and y is an integer that is 1 or greater than 1. Preferably, wherein x is an integer from about 1 to about 120,000, preferably from about 2 to about 60,000, more preferably from about 3 to about 24,000 and y is an integer from about 1 to about 60,000, preferably from about 2 to about 30,000, more preferably from about 3 to about 12,000.

Various commercial polyethyleneimines are available, including for example those sold under the tradename Lupasol® (BASF), including for example Lupasol® FG, Lupasol® G, Lupasol® PR 8515, Lupasol® WF, Lupasol® G 20/35/100, Lupasol® HF, Lupasol® P, Lupasol® PS, Lupasol® PO 100, Lupasol® PN 50/60, and Lupasol® SK. Such exemplary polyethyleneimines are available as anhydrous polyethyleneimines and/or modified polyethyleneimines provided in aqueous solutions or methoxypropanol (Lupasol® PO 100). The molar mass of the polyethyleneimines, including modified polyethyleneimines can vary from about 800 g/mol to at least 2,000,000 g/mol.

In certain aspects the polymeric amine bleach activators, and preferably the PEI bleach activators, may be a branched, spherical polymeric amine. In further aspects, the molecular weight of the polymeric amine bleach activators or PEI bleach is from about 100 Daltons to about 2 million Daltons (PEI-2,000,000), more preferably from about 100 Daltons to about 1 million Daltons (PEI-1,000,000), more preferably from about 500 Daltons to about 500 kDa (PEI-500,000), more preferably from about 500 Daltons to about 50 kDa (PEI-50,000), more preferably from about 800 Daltons to about 50 kDa (PEI-50,000), more preferably from about 800 Daltons to about 10 kDa (PEI-10,000). In further aspects, the charge density of the PEI or PEI salt is from about 15 meq/g to about 25 meq/g, more preferably from about 16 meq/g to about 20 meq/g. Commercially-available examples of such preferred PEIs include the BASF products LUPASOL® WF (25 kDa; 16-20 meq/g) and Lupasol® FG (800 Daltons; 16-20 meq/g), and the BASF products in the SOKALAN® family of polymers, e.g., SOKALAN® HP20, SOKALAN® HP22 G, and the like.

In an aspect, a polymeric amine may contain other substituents and/or and copolymers. For example, a polymeric amine may also include substituents, including for example ethoxylates and propoxylates. In an aspect of the invention, the polymeric amine, such as a polyethyleneimines, are derivatized with ethylene oxide (EO) and/or propylene oxide (PO) side chains. According to the invention, the PEI does not contain propylene oxide side chains. In an exemplary aspect of the invention ethoxylated PEIs may be heavily branched, wherein the substitutable hydrogens on the primary and secondary nitrogens are replaced with ethoxylated chains containing varying degrees of repeating units, such as the following polymer structure (generic for $PEI_{20}EO$):

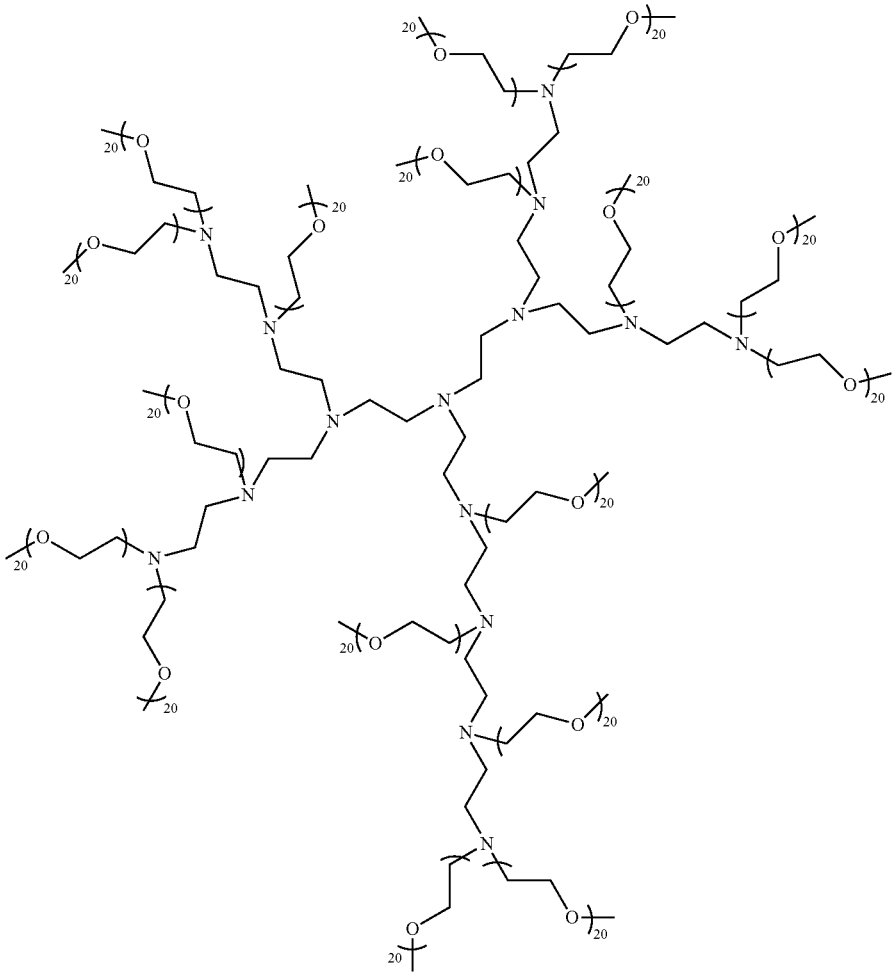

In an aspect, the bleach activator is a polyethyleneimine polymer with ethyleneoxide chains. Ethoxylation of PEIs increases the solubility of the bleach activator according to the invention.

A polymeric amine may also include copolymers, including for example ethylenediamine. A variety of substituents and/or copolymers may be included in order to modify the solubility or any other physical characteristics of a particular polymeric amine employed as a bleach activator according to the invention.

Because of the presence of amine groups, PEI can be protonated with acids to form a PEI salt from the surrounding medium resulting in a product that is partially or fully ionized depending on pH. For example, about 73% of PEI is protonated at pH 2, about 50% of PEI is protonated at pH 4, about 33% of PEI is protonated at pH 5, about 25% of PEI is protonated at pH 8 and about 4% of PEI is protonated at pH 10. In general, PEIs can be purchased as their protonated or unprotonated form with and without water. An example of a segment of a branched protonated polyethyleneimine (PEI salt) is shown below:

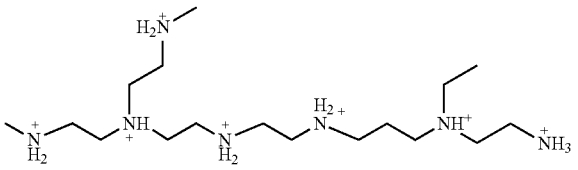

The counter ion of each protonated nitrogen center is balanced with an anion of an acid obtained during neutralization. Examples of protonated PEI salts include, but are not limited to, PEI-hydrochloride salt, PEI-sulfuric acid salt, PEI-nitric acid salt, PEI-acetic acid salt PEI fatty acid salt and the like. In fact, any acid can be used to protonate PEIs resulting in the formation of the corresponding PEI salt compound.

The cationic polymer for foam stabilization, if present is present in an amount of from about 0.01 wt. % to about 5 wt. %; preferably from about 0.05 wt. % to about 3 wt. % and more preferably from about 0.1 wt. % to about 2 wt. %. At greater than 5 wt. % the affect is decreased and this is a critical upper limit.

Preservative

The liquid cleaning composition can include effective amounts of preservatives. The preservatives may serve a preservative and stabilizing function. When the cleaning composition includes a preservative, the preservative can be provided in amount of between about 0.001 wt. % and about 1 wt. %. Example preservatives include but are not limited to methylchloroisothiazolinone (CMIT), methylisothiazolinone (MIT), glutaraldehyde, 1,2-benzisothiazoline-3-one (BIT), polyhexamethylenebiguanide hydrochloride (PHMB), phenoxyethanol, methylparaben, propyl P-hydroxybenzoate (propyl paraben) and sodium benzoate NF dense. Another suitable preservative is Neolone™ M-10, a 9.5% active preservative available from Dow.

Water

The cleaning compositions of the invention may include a polar carrier media, such as water, alcohols, for example low molecular weight primary or secondary alcohols exemplified by methanol, ethanol, propanol, isopropanol, and the like, or other polar solvents, or mixtures and combinations thereof.

It should be appreciated that water may be provided as deionized water or as softened water. The water or other polar carrier may be present in the composition in the range of about 55 wt. % to about 95 wt. %, in the range of about 60 wt. % to about 90 wt. %, or in the range of about 65 wt. % to about 85 wt. % based on the total actives weight of the composition. Typically the water will make up any remainder of the liquid composition after other components are specified.

Additional Materials

The compositions may also include additional materials, such as additional functional materials, for example enzymes, enzyme stabilizing system, additional surfactant, chelating agents, sequestering agents, bleaching agents, thickening agents detergent filler, anti-redeposition agents, a threshold agent or system, aesthetic enhancing agent (i.e. dye, perfume, etc.) and the like, or combinations or mixtures thereof. Adjuvants and other additive ingredients will vary according to the type of composition being manufactured and can be included in the compositions in any amount. The following is a brief discussion of some examples of such additional materials Additional Surfactant In addition to the surfactants specified above, the composition may also include other surfactants as enumerated hereinafter.

Zwitterionic Surfactants

Zwitterionic surfactants can be thought of as a subset of the amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion, a negative charged carboxyl group, and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

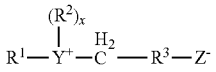

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-car-boxylate; 5-[S-3-hydroxypropyl-S-hexadecylsulfonio]-3-hydroxypentane-1-sul-fate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propan-e-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxyl-ate; 3-[S-ethyl-S-(3-dodecoxy-2-hydroxypropyl)sulfonio]-propane-1-phosphat-e; 3-[P,P-dimethyl-P-dodecylphosphonio]-propane-1-phosphonate; and S [N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present compositions includes a betaine of the general structure:

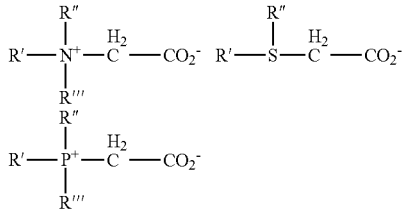

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R1)_2N.sup.+R^2SO^3$—, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Betaines and sultaines and other such zwitterionic surfactants are present in an amount of from Anionic surfactants are present in the composition in any detersive amount which can range typically from about 0.01 wt. % to about 75 wt. % of the cleaning composition. In a preferred embodiment, about 10 wt. % to about 30 wt. % and more preferably from about 15 wt. % to about 25 wt. %.

Semi-Polar Nonionic Surfactants

The semi-polar type of nonionic surface active agents is another class of nonionic surfactant useful in compositions of the present invention. Generally, semi-polar nonionics are high foamers and foam stabilizers, which can limit their application in CIP systems. However, within compositional embodiments of this invention designed for high foam cleaning methodology, semi-polar nonionics would have immediate utility. The semi-polar nonionic surfactants include the amine oxides, phosphine oxides, sulfoxides and their alkoxylated derivatives.

Amine oxides are tertiary amine oxides corresponding to the general formula:

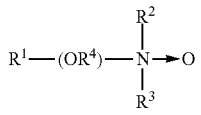

wherein the arrow is a conventional representation of a semi-polar bond; and $R^1$, $R^2$, and $R^3$ may be aliphatic, aromatic, heterocyclic, alicyclic, or combinations thereof. Generally, for amine oxides of detergent interest, $R^1$ is an alkyl radical of from 8 to 24 carbon atoms; $R^2$ and $R^1$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to 20.

Useful water soluble amine oxide surfactants are selected from the coconut or tallow alkyl di-(lower alkyl) amine oxides, specific examples of which are dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-h-ydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

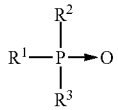

wherein the arrow is a conventional representation of a semi-polar bond; and $R^1$ is an alkyl, alkenyl or hydroxyalkyl moiety ranging from 10 to 24 carbon atoms in chain length; and $R^2$ and $R^1$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphine oxide, dimethylhexadecylphosphine oxide, diethyl-2-hydroxyoctyldecylphosp-hine oxide, bis(2-hydroxyethyl)dodecylphosphine oxide, and bis (hydroxymethyl)tetradecylphosphine oxide. Semi-polar nonionic surfactants useful herein also include the water soluble sulfoxide compounds which have the structure:

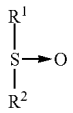

wherein the arrow is a conventional representation of a semi-polar bond; and, $R^1$ is an alkyl or hydroxyalkyl moiety of 8 to 28 carbon atoms, from 0 to 5 ether linkages and from 0 to 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y— and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

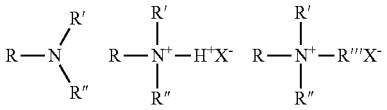

in which, R represents a long alkyl chain, R', R", and R'" may be either long alkyl chains or smaller alkyl or aryl groups or hydrogen and X represents an anion. The amine salts and quaternary ammonium compounds are preferred for practical use in this invention due to their high degree of water solubility.

The majority of large volume commercial cationic surfactants can be subdivided into four major classes and additional sub-groups known to those of skill in the art and described in "Surfactant Encyclopedia," Cosmetics & Toiletries, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1{}_mR^2{}_xYLZ$ wherein each $R^1$ is an organic group containing a straight or branched alkyl or alkenyl group optionally substituted with up to three phenyl or hydroxy groups and optionally interrupted by up to four of the following structures:

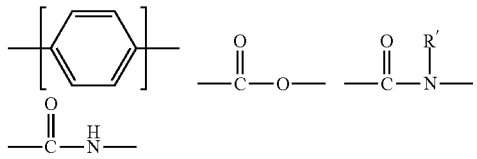

or an isomer or mixture of these structures, and which contains from 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2, or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group is filled by hydrogens.

Y can be a group including, but not limited to:

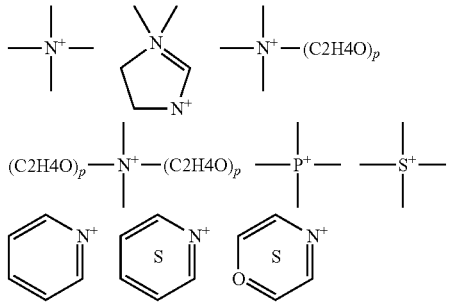

p = about 1 to 12 or a mixture thereof.

Preferably, L is 1 or 2, with the Y groups being separated by a moiety selected from $R^1$ and $R^2$ analogs (preferably alkylene or alkenylene) having from 1 to 22 carbon atoms and two free carbon single bonds when L is 2. Z is a water soluble anion, such as sulfate, methylsulfate, hydroxide, or nitrate anion, particularly preferred being sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of the anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia," Cosmetics & Toiletries, Vol. 104 (2) 69-71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

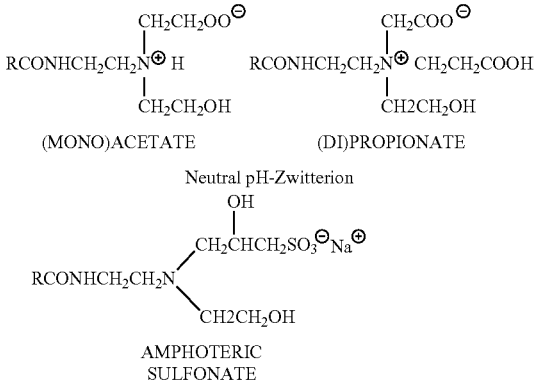

wherein R is an acyclic hydrophobic group containing from 8 to 18 carbon atoms and M is a cation to neutralize the charge of the anion, generally sodium. Commercially prominent imidazoline-derived amphoterics that can be employed in the present compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Preferred amphocarboxylic acids are produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reacting $RNH_2$, in which R.dbd.$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In these, R is preferably an acyclic hydrophobic group containing from 8 to 18 carbon atoms, and M is a cation to neutralize the charge of the anion.

Preferred amphoteric surfactants include those derived from coconut products such as coconut oil or coconut fatty acid. The more preferred of these coconut derived surfactants include as part of their structure an ethylenediamine moiety, an alkanolamide moiety, an amino acid moiety, preferably glycine, or a combination thereof; and an aliphatic substituent of from 8 to 18 (preferably 12) carbon atoms. Such a surfactant can also be considered an alkyl amphodicarboxylic acid. Disodium cocoampho dipropionate is one most preferred amphoteric surfactant and is commercially available under the tradename Miranol™ FBS from Rhodia Inc., Cranbury, N.J. Another most preferred coconut derived amphoteric surfactant with the chemical name disodium cocoampho diacetate is sold under the tradename Miranol C2M-SF Conc., also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Additional surfactant may be present in the compositions in any detersive amount so long as they do not interfere with the electrostatic, ionic interactions that provide for foam stabilization.

Enzymes

The composition of the invention may include one or more enzymes, which can provide desirable activity for removal of protein-based, carbohydrate-based, or triglyceride-based stains from substrates; for cleaning, destaining, and sanitizing presoaks, such as presoaks for flatware, cups and bowls, and pots and pans; presoaks for medical and dental instruments; or presoaks for meat cutting equipment; for machine warewashing; for laundry and textile cleaning and destaining; for carpet cleaning and destaining; for cleaning-in-place and destaining-in-place; for cleaning and destaining food processing surfaces and equipment; for drain cleaning; presoaks for cleaning; and the like. Enzymes may act by degrading or altering one or more types of soil residues encountered on a surface or textile thus removing the soil or making the soil more removable by a surfactant or other component of the cleaning composition. Both degradation and alteration of soil residues can improve detergency by reducing the physicochemical forces which bind the soil to the surface or textile being cleaned, i.e. the soil becomes more water soluble. For example, one or more proteases can cleave complex, macromolecular protein structures present in soil residues into simpler short chain molecules which are, of themselves, more readily desorbed from surfaces, solubilized or otherwise more easily removed by detersive solutions containing said proteases.

Suitable enzymes may include a protease, an amylase, a lipase, a gluconase, a cellulase, a peroxidase, or a mixture thereof of any suitable origin, such as vegetable, animal, bacterial, fungal or yeast origin. Selections are influenced by factors such as pH-activity and/or stability optima, thermostability, and stability to active detergents, builders and the like. In this respect bacterial or fungal enzymes may be preferred, such as bacterial amylases and proteases, and fungal cellulases. Preferably the enzyme may be a protease, a lipase, an amylase, or a combination thereof. Enzyme may be present in the composition from at least 0.01 wt. %, or 0.01 to 2 wt. %.

Enzyme Stabiliziag System

The composition of the invention may include an enzyme stabilizing system. The enzyme stabilizing system can include a boric acid salt, such as an alkali metal borate or amine (e. g. an alkanolamine) borate, or an alkali metal borate, or potassium borate. The enzyme stabilizing system can also include other ingredients to stabilize certain enzymes or to enhance or maintain the effect of the boric acid salt.

For example, the cleaning composition of the invention can include a water soluble source of calcium and/or magnesium ions. Calcium ions are generally more effective than magnesium ions and are preferred herein if only one type of cation is being used. Cleaning and/or stabilized enzyme cleaning compositions, especially liquids, may include 1 to 30, 2 to 20, or 8 to 12 millimoles of calcium ion per liter of finished composition, though variation is possible depending on factors including the multiplicity, type and levels of enzymes incorporated. Water-soluble calcium or magnesium salts may be employed, including for example calcium chloride, calcium hydroxide, calcium formate, calcium malate, calcium maleate, calcium hydroxide and calcium acetate; more generally, calcium sulfate or magnesium salts corresponding to the listed calcium salts may be used. Further increased levels of calcium and/or magnesium may of course be useful, for example for promoting the grease-cutting action of certain types of surfactant.

Stabilizing systems of certain cleaning compositions, for example warewashing stabilized enzyme cleaning compositions, may further include 0 to 10%, or 0.01% to 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during warewashing, can be relatively large; accordingly, enzyme stability to chlorine in-use can be problematic.

Suitable chlorine scavenger anions are known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used.

Chelating/Sequestering Agent

The composition may include a chelating/sequestering agent such as an aminocarboxylic acid, a condensed phosphate, a phosphonate, a polyacrylate, and the like. In general, a chelating agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount. The composition may include 0.1-70 wt. %, or 5-60 wt. %, of a chelating/sequestering agent. An iminodisuccinate (available commercially from Bayer as IDS™) may be used as a chelating agent.

Useful aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetri-acetic acid (HEDTA), diethylenetriaminepentaacetic acid (DTPA), and the like.

Examples of condensed phosphates useful in the present composition include sodium and potassium orthophosphate, sodium and potassium pyrophosphate, sodium tripolyphosphate, sodium hexametaphosphate, and the like.

The composition may include a phosphonate such as 1-hydroxyethane-1,1-diphosphonic acid and the like.

Polymeric polycarboxylates may also be included in the composition. Those suitable for use as cleaning agents have pendant carboxylate groups and include, for example, polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, hydrolyzed acrylonitrile-methacrylonitrile copolymers, and the like. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein.

Bleaching Agents

Bleaching agents for lightening or whitening a substrate, include bleaching compounds capable of liberating an active halogen species, such as $Cl_2$, $Br_2$, —$OCl^-$ and/or —$OBr^-$, under conditions typically encountered during the cleansing process. Suitable bleaching agents include, for example, chlorine-containing compounds such as a chlorine, a hypochlorite, chloramine. Halogen-releasing compounds may include the alkali metal dichloroisocyanurates, chlorinated trisodium phosphate, the alkali metal hypochlorites, monochloramine and dichloramine, and the like. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, phosphate peroxyhydrates, potassium permonosulfate, and sodium perborate mono and tetrahydrate, with and without activators such as tetraacetylethylene diamine, and the like. A cleaning composition may include a minor but effective amount of a bleaching agent, such as 0.1-10 wt. %, or 1-6 wt. %.

Detergent Builders or Fillers

A composition may include a minor but effective amount of one or more of a detergent filler which does not perform as a cleaning agent per se, but cooperates with the cleaning agent to enhance the overall cleaning capacity of the composition. Examples of fillers suitable for use in the present cleaning compositions include sodium sulfate, sodium chloride, starch, sugars, $C_1$-$C_{10}$ alkylene glycols such as propylene glycol, and the like. Inorganic or phosphate-containing detergent builders may include alkali metal, ammonium and alkanolammonium salts of polyphosphates (e.g. tripolyphosphates, pyrophosphates, and glassy polymeric meta-phosphates). Non-phosphate builders may also be used. A detergent filler may be included in an amount of 1-20 wt. %, or 3-15 wt. %.

Anti-Redeposition Agents

The composition may include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. The composition may include 0.5-10 25 wt. %, or 1-5 wt. %, of an anti-redeposition agent.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as CIS-jasmine orjasmal, vanillin, and the like.

Divalent Ion

The compositions of the invention may contain a divalent ion, selected from calcium and magnesium ions, at a level of from 0.05% to 5% by weight, or from 0.1% to 1% by weight, or 0.25% by weight of the composition. The divalent ion can be, for example, calcium or magnesium. The calcium ions can, for example, be added as a chloride, hydroxide, oxide, formate, acetate, nitrate salt.

Thickening Agent

In some embodiments, it is contemplated that a thickening agent may be included, however, in many embodiments, it is not required. Some examples of additional thickeners include soluble organic or inorganic thickener material. Some examples of inorganic thickeners include clays, silicates and other well-known inorganic thickeners. Some examples of organic thickeners include thixotropic and non-thixotropic thickeners. In some embodiments, the thickeners have some substantial proportion of water solubility to promote easy removability. Examples of useful soluble organic thickeners for the compositions of the invention comprise carboxylated vinyl polymers such as polyacrylic acids and sodium salts thereof, ethoxylated cellulose, polyacrylamide thickeners, xanthan thickeners, guargum, sodium alginate and algin by-products, hydroxy propyl cellulose, hydroxy ethyl cellulose and other similar aqueous thickeners that have some substantial proportion of water solubility.

Alkaline Sources

The cleaning composition produced according to the invention may include minor but effective amounts of one or more alkaline sources to neutralize the anionic surfactants and improve soil removal performance of the composition. Accordingly, an alkali metal or alkaline earth metal hydroxide or other hydratable alkaline source, is preferably included in the cleaning composition in an amount effective to neutralize the anionic surfactant. However, it can be appreciated that an alkali metal hydroxide or other alkaline source can assist to a limited extent, in solidification of the composition. Although the amount of alkali metal and alkaline earth metal hydroxide is necessitated to neutralize the anionic surfactant as above described, additional alkaline sources may be present to a point where the pH of an aqueous solution does not exceed 9.

Suitable alkali metal hydroxides include, for example, sodium or potassium hydroxide. Suitable alkaline earth metal hydroxides include, for example, magnesium hydroxide. An alkali or alkaline earth metal hydroxide may be added to the composition in the form of solid beads, dissolved in an aqueous solution, or a combination thereof. Alkali and alkaline earth metal hydroxides are commercially available as a solid in the form of prilled beads having a mix of particle sizes ranging from about 12-100 U.S. mesh, or as an aqueous solution, as for example, as a 50 wt.-% and a 73 wt.-% solution. It is preferred that the alkali or alkaline earth metal hydroxide is added in the form of an aqueous solution, preferably a 50 wt.-% hydroxide solution, to reduce the amount of heat generated in the composition due to hydration of the solid alkali material.

A cleaning composition may include a secondary alkaline source other than an alkali metal hydroxide. Examples of secondary alkaline sources include a metal silicate such as sodium or potassium silicate or metasilicate, a metal carbonate such as sodium or potassium carbonate, bicarbonate or sesquicarbonate, and the like; a metal borate such as sodium or potassium borate, and the like; ethanolamines and amines; and other like alkaline sources. Secondary alkalinity agents are commonly available in either aqueous or powdered form, either of which is useful in formulating the present cleaning compositions.

Methods of Making the Compositions

The compositions according to the invention are easily produced by any of a number of known art techniques. Conveniently, a part of the water is supplied to a suitable mixing vessel further provided with a stirrer or agitator, and while stirring, the remaining constituents are added to the mixing vessel, including any final amount of water needed to provide to 100% wt. of the inventive composition.

The compositions may be packaged in any suitable container particularly flasks or bottles, including squeeze-type bottles, as well as bottles provided with a spray apparatus (e.g. trigger spray) which is used to dispense the composition by spraying. Accordingly the compositions are desirably provided as a ready to use product in a manually operated spray dispensing container.

Preferably, the composition is adapted for being dispensed using a trigger spray. Alternately, preferably, the composition is adapted for being dispensed using a squeeze bottle through a nozzle.

Whereas the compositions of the present invention are intended to be used in the types of liquid forms described, nothing in this specification shall be understood as to limit the use of the composition according to the invention with a further amount of water to form a cleaning solution there from. In such a proposed diluted cleaning solution, the greater the proportion of water added to form said cleaning dilution will, the greater may be the reduction of the rate and/or efficacy of the thus formed cleaning solution.

Whereas the compositions of the present invention are intended to be used in the types of liquid forms described, nothing in this specification shall be understood as to limit the use of the composition according to the invention with a further amount of water to form a cleaning solution there from. In such a proposed diluted cleaning solution, the greater the proportion of water added to form said cleaning dilution will, the greater may be the reduction of the rate and/or efficacy of the thus formed cleaning solution. Accordingly, longer residence times upon the stain to affect their loosening and/or the usage of greater amounts may be necessitated. Preferred dilution ratios of the concentrated hard surface cleaning composition:water of 1:1-100, preferably 1:2-100, more preferably 1:3-100, yet more preferably 1:10-100, and most preferably 1:16-85, on either a weight/weight ("w/w") ratio or alternately on a volume/volume ("v/v") ratio.

Conversely, nothing in the specification shall be also understood to limit the forming of a "super-concentrated" cleaning composition based upon the composition described above. Such a super-concentrated ingredient composition is essentially the same as the cleaning compositions described above except in that they include a lesser amount of water.

In other embodiments, the invention provides a dishware cleaning composition comprising one or more of the above-described cleaning compositions of the invention and one or more additional dishware cleaning components (such as one or more enzymes, one or more rinse aids, one or more surfactants, one or more builders, one or more bleaches or bleach-generating compounds or systems, and the like. In certain such embodiments, the dishware cleaning composition is provided as a liquid composition, spray, aerosol or as a foaming gel composition. In additional such embodiments, the dishware cleaning to composition is provided in unit dose format, such as in a water-dissolvable (e.g., polyvinyl alcohol) pouch, tablet, or the like, suitable for use in automatic dishwashing machines.

Methods of Cleaning

The present invention also relates to methods of cleaning a soiled object. This embodiment of the method can include contacting the object with a cleaning composition of the invention. The cleaning steps can be provided in a number of ways depending on the specific formulation. In an embodiment, the method can include contacting the object with cleaning composition according to the in any of a number of for a predetermined time, preferably for a sufficient amount of time to allow any foam to dissipate; and after passage of the predetermined time, rising the cleaning composition from the object so that the cleaning composition and any soils or debris are washed away. The method can be employed to clean any of a variety of objects.

Exemplary Compositions

The table below gives useful, preferred and more preferred composition ranges for each essential ingredient in the invention on a percent actives basis:

| | most preferred | more preferred | preferred |
|---|---|---|---|
| water | 65-85 | 60-90 | 55-95 |
| salt | 0.1-5 | 0.05-6.5 | 0.01-8 |
| aromatic sulfonate | 0.1-5 | 0.05-7.5 | 0.01-10 |
| protic solvent | 0.1-5 | 0.05-7.5 | 0.01-10 |
| nonionic surfactant | 0.1-2 | 0.05-5 | 0.01-7.5 |
| foam stabilizer components | 10-25 | 7.5-30 | 5-35 |

The present invention will now be further illustrated by way of the following non-limiting examples, in which parts and percentages are by weight unless otherwise indicated.

EXAMPLES

Example 1

Viscosity of various formulations were measured using a Brookfield viscometer according to the manufacturers' specifications.

Lutensol XP is a line of branched nonionic surfactants available from BASF in Ludwigshafen, Germany. They are alkyl polyethylene glycol ethers based on $C_{10}$-Guerbet alcohol and ethylene oxide. The Lutensol® XP types are manufactured, by reacting the $C_{10}$-alcohol with ethylene oxide in stoichiometric proportions. The numeric portion of the product name indicates the general degree of ethoxylation.

TABLE 1

CocoDEA free Pot & Pan Formulas with Lutensol XP 80

| Description | Formulation A Wgt. % | Formulation B Wgt. % | Formulation C Wgt. % |
|---|---|---|---|
| Water Zeolite Softened | 47.28 | 47.17 | 47.75 |
| Citric Acid, TAN - 50% | 0 | 0 | 1.00 |
| Sodium Chloride: FCC Gran | 2.3 | 2.34 | 0.75 |
| Sodium Xylene Sulfonate - 40% | 0 | 0 | 0 |
| Lutensol XP 80 | 3.5 | 1.75 | 3.49 |
| Propylene Glycol, TECH | 0 | 1.75 | 0 |
| Sodium Lauryl Ether Ethoxy Sulfate - 60% (SLES) | 8 | 7.98 | 7.98 |
| Sodium C14-C16 Olefin Sulfonate - 40% (AOS) | 22.49 | 22.6 | 22.61 |
| Lauryl Dimethylamine Oxide - 30% (AO) | 15.66 | 15.64 | 15.63 |
| PEI Ethoxylate | 0.5 | 0.5 | 0.5 |
| Glutaraldehyde - 50% | 0.02 | 0.02 | 0.02 |
| Fragrance | 0.26 | 0.26 | 0.26 |
| Dye | 0.0014 | 0.0017 | 0.0014 |

TABLE 2

CocoDEA free Pot & Pan Formulas with Lutensol XP 80 (continued).

| Description | Formulation D Wgt. % | Formulation E Wgt. % |
|---|---|---|
| Water Zeolite Softened | 45.78 | 51.3 |
| Citric Acid, TAN - 50% | 0 | 1 |
| Sodium Chloride: FCC Gran | 2.3 | 0.76 |
| Sodium Xylene Sulfonate - 40% | 0 | 0 |
| Lutensol XP 80 | 5 | 0 |
| Propylene Glycol, TECH | 0 | 0 |
| Sodium Lauryl Ether Ethoxy Sulfate - 60% (SLES) | 8 | 8.04 |
| Sodium C14-C16 Olefin Sulfonate - 40% (AOS) | 22.49 | 22.48 |
| Lauryl Dimethylamine Oxide - 30% (AO) | 15.66 | 15.64 |
| PEI Ethoxylate | 0.5 | 0.51 |
| Glutaraldehyde - 50% | 0.02 | 0.02 |
| Fragrance | 0.26 | 0.26 |
| Dye | 0.0001 | 0.0011 |

TABLE 3

CocoDEA free Pot & Pan Formulas with Lutensol XP 50.

| Description | Formulation F Wgt. % | Formulation G Wgt. % |
|---|---|---|
| Water Zeolite Softened | 49.27 | 48.75 |
| Citric Acid, TAN - 50% | 0.39 | 0.37 |

TABLE 3-continued

CocoDEA free Pot & Pan Formulas with Lutensol XP 50.

| Description | Formulation F Wgt. % | Formulation G Wgt. % |
|---|---|---|
| Sodium Hydroxide - 50% | 0 | 0 |
| Sodium Chloride: FCC Gran | 0 | 0 |
| Sodium Xylene Sulfonate - 40% | 0 | 0 |
| Lutensol XP-50 | 0.5 | 1 |
| Propylene Glycol, TECH | 2.99 | 2.99 |
| Sodium Lauryl Ether Ethoxy Sulfate - 60% (SLES) | 7.97 | 8.03 |
| Sodium C14-C16 Olefin Sulfonate - 40% (AOS) | 22.4 | 22.41 |
| Lauryl Dimethylamine Oxide - 30% (AO) | 15.53 | 15.51 |
| PEI Ethoxylate | 0.53 | 0.5 |
| Glutaraldehyde - 50% | 0.02 | 0.02 |
| Fragrance | 0.26 | 0.26 |
| Dye | 0.15 | 0.15 |

TABLE 4

CocoDEA free Pot & Pan Formulas with Lutensol XP50 (continued).

| Description | Formulation H Wgt. % | Formulation I Wgt. % |
|---|---|---|
| Water Zeolite Softened | 47.71 | 55.37 |
| Citric Acid, TAN - 50% | 0.34 | 0.36 |
| Sodium Hydroxide - 50% | 0 | 0 |
| Sodium Chloride: FCC Gran | 0 | 0 |
| Sodium Xylene Sulfonate - 40% | 0 | 0 |
| Lutensol XP-50 | 1.99 | 3.56 |
| Propylene Glycol, TECH | 3.06 | 3.55 |
| Sodium Lauryl Ether Ethoxy Sulfate - 60% (SLES) | 7.97 | 9.44 |
| Sodium C14-C16 Olefin Sulfonate - 40% (AOS) | 22.37 | 26.53 |
| Lauryl Dimethylamine Oxide - 30% (AO) | 15.56 | 0.68 |
| PEI Ethoxylate | 0.58 | 0.02 |
| Glutaraldehyde - 50% | 0.02 | 0.3 |
| Fragrance | 0.26 | 0.18 |
| Dye | 0.15 | 0.15 |

TABLE 5

Pot & Pan Formulas with Lutensol XP80.

| Description | Formulation J Wgt., % | Formulation K Wgt., % | Formulation L Wgt., % |
|---|---|---|---|
| Water Zeolite Softened | 68.72 | 70.79 | 66.15 |
| Sodium Chloride | 4.23 | 4.14 | 4.18 |
| Sodium Xylene Sulfonate 40% | 1.99 | 0 | 2.05 |
| Lutensol XP 80 | 0 | 0 | 0.5 |
| Propylene Glycol | 0 | 0 | 1.99 |
| Sodium Lauryl Ether Ethoxy Sulfate 60% | 4.41 | 4.41 | 4.41 |
| Sodium C14-16 Olefin Sulfonate (40%) | 11.55 | 11.54 | 11.54 |
| Lauryl Dimethylamine Oxide 30% | 8.16 | 8.14 | 8.15 |
| PEI Ethoxylate | 0.5 | 0.54 | 0.6 |
| Glutaraldehyde 50% | 0.02 | 0.02 | 0.02 |
| Fragrance | 0.26 | 0.26 | 0.26 |
| Dye | 0.15 | 0.15 | 0.15 |

TABLE 6

Pot & Pan Formulas with Lutensol XP80 (continued).

| Description | Formulation M Wgt., % | Formulastion N Wgt., % |
|---|---|---|
| Water Zeolite Softened | 68.22 | 67.87 |
| Sodium Chloride | 4.19 | 4.12 |
| Sodium Xylene Sulfonate 40% | 0 | 0.98 |
| Lutensol XP-80 | 0.5 | 0.49 |
| Propylene Glycol | 2.01 | 1.96 |
| Sodium Lauryl Ether Ethoxy Sulfate 60% | 4.42 | 4.33 |
| Sodium C14-16 Olefin Sulfonate (40%) | 11.56 | 11.33 |
| Lauryl Dimethylamine Oxide 30% | 8.15 | 8 |
| PEI Ethoxylate | 0.53 | 0.5 |
| Glutaraldehyde 50% | 0.02 | 0.02 |
| Fragrance | 0.26 | 0.26 |
| Dye | 0.15 | 0.15 |

As can be seen, formulas 13668-69-2 which did not include Lutensol XP-80 and formula 13668-6904 which did not include the SXS coupling agent demonstrates a much quicker dispense rates and thus lower viscosity.

Figure 2:
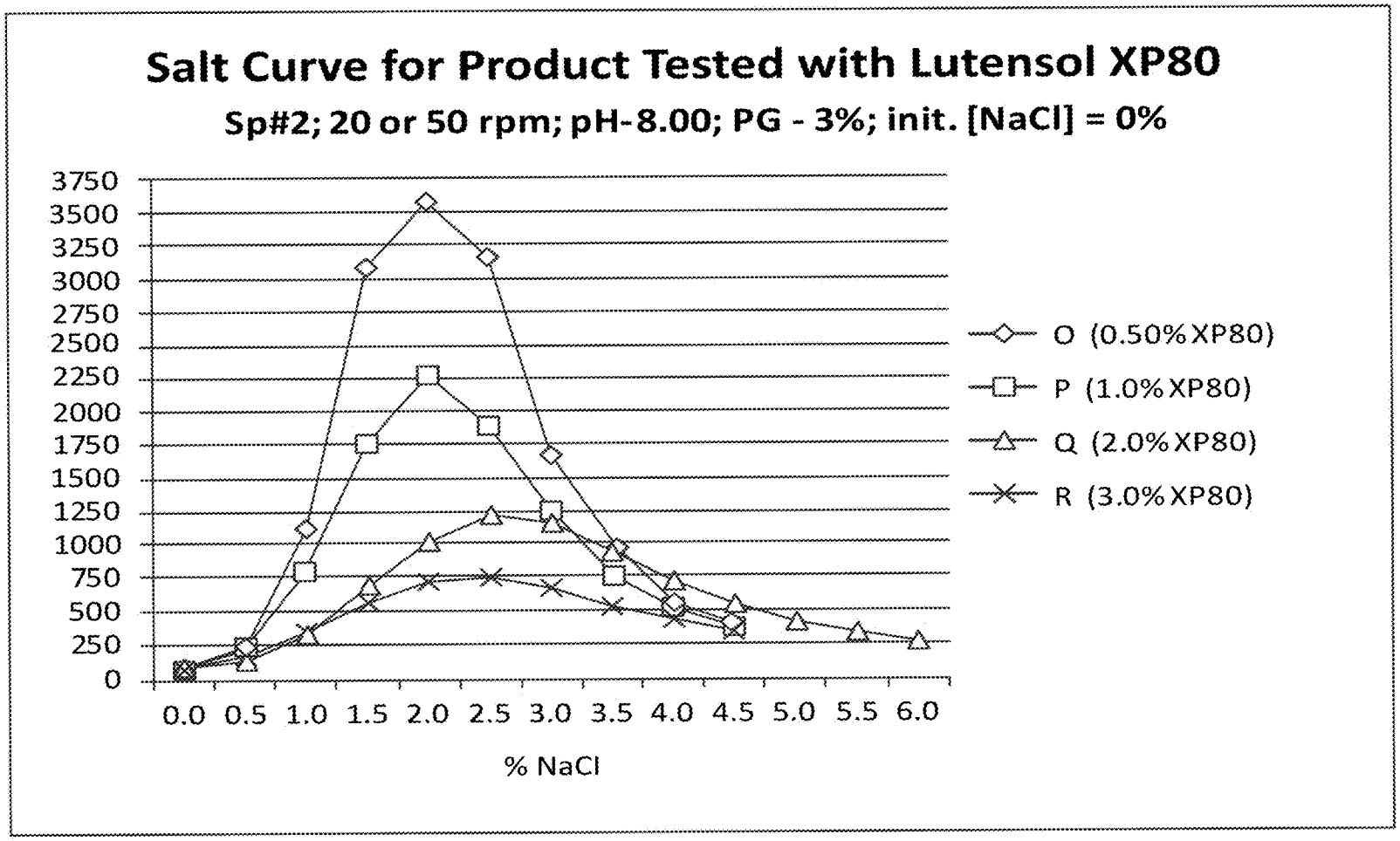
FIG. 2 is a salt curve graph for Lutensol XP 80.

Tables 7 and 8 and FIGS. 1 and 2 show variations with fixed amounts of Sodium Lauryl Ether Sulfonate, Sodium C14-16 Olefin and Lauryl Dimethylamine Oxide. The variables were sodium chloride from 0-5%, SXS from 0-5%, Propylene glycol from 0-5%. Another variation was pH from 7.0-9.0 adjusting with citric acid or caustic soda as needed. Then salt curve work was undertaken, adding the XP-50 or XP-80 (results in tables 8 and 9 and FIGS. 1 and 2). The salt curve of interest was using a fixed formula, then adjusting the Alcohol ethoxylate from 0-5% as in XP-80. All responses for these purposes were viscosity (therefore dispensable at desired rates).

Table 7 shows the Salt curve data for Lutensol XP50. The results are shown graphically in FIG. 1 from formulas shown in Tables 3 and 4. The results indicate that the formulas 63-3 and 63-4 which included no neutral salt where much less viscous that the formulas that did include the salt.

TABLE 7

Salt Curve Data used in a DOE.
Lutensol XP50 (Salt Curve Data)
(RVT, Spindle #2, 50 rpm, unless otherwise specified; ca. 73 F.)

| Salt, Wgt. % | Formulation F (0.50% XP50) | Formulation G (1.0% XP50) | Formulation H (2.0% XP50) | Formulation I (3.0% XP50) |
|---|---|---|---|---|
| 0.0 | 78.4 | 86.4 | 116.8 | 171.2 |
| 0.5 | 292.8 | 342.4 | 392 | 456.2 |
| 1.0 | 968 | 1124 | 923.2 | 753.6 |
| 1.5 | 1992 | 2256 | 1248 | 748.8 |
| 2.0 | 3516 | 2184 | 1014 | 544 |
| 2.5 | 2236 | 1396 | 691.2 | 387.2 |
| 3.0 | 1220 | 816 | 432 | 342.4 |
| 3.5 | 684 | 496 | 350.4 | 313.6 |
| 4.0 | 438.4 | 337.6 | 315.2 | |
| 4.5 | 435.2 | 276.8 | 299.2 | |
| 5.0 | 265.60 | 248.00 | | |
| 5.5 | 227.20 | 235.20 | | |
| 6.0 | | | | |

Viscosity was measured using the following protocol.

Apparatus: Brookfield Viscometer, model RVT or LVT
Brookfield Small Sample Adapter with spindles
Water bath
250 mL, 400 mL or 600 mL beakers with >3.5" diameter
RV and LV spindles (#1 to #5), T-bar spindles (TA to TF)

Factor finder

Reagents: 50 cps Silicone Standard*

100 cps Silicone Standard*

500 cps Silicone Standard*

5000 cps Silicone Standard*

*All Standards are purchased from Brookfield Engineering with an expiration date of 1 year from date received.

Procedure: Use the specified spindle and speed as shown in the EPIC bill of quality (BOQ). If none is shown determine which spindle is to be used for the viscosity measurement.

Brookfield LVT Viscometer is applicable to liquids with viscosities from 15 cps-2,000,000 cps. The guard leg is required for measurements taken with spindles 1 and 2.

Brookfield RVT Viscometer is applicable to liquids with viscosities from 100 cps-8,000,000 cps.

Samples tested with the Helipath spindles need to be transferred to a glass 250 mL beaker and adjusted to temperature.

It may be necessary to tilt the spindle slightly while placing it into the sample to avoid trapping air bubbles on the spindle's surface. Do not test if bubbles are trapped on the spindle. Remove bubbles prior to testing.

Each digital or programmable viscometer is slightly different. Refer to the instrument manual or SOP for specific instructions on auto-zeroing, setting the spindle information and setting the speed.

Non-Digital Viscometer Models

1. Transfer the sample into the specified size beaker and adjust the temperature to that called for in the BOQ. If a temperature is not specified, test at 25° C.±0.5° C.
2. Place the spindle into the sample and attach the spindle to the viscometer.
3. Adjust the height until the fluid level is at the immersion groove cut in the spindle shaft.
4. Level the instrument using the bubble indicator.
5. Depress the clutch and turn on the motor.
6. Release the clutch and set the speed control knob at the correct speed (rpm).
7. Run the viscometer until the pointer stabilizes at a fixed position on the dial, typically 1 min unless otherwise stated in the BOQ.
8. Depress the clutch, stop the motor with the pointer in view, and record the reading.

If the reading is below 10, retest using a higher speed or smaller spindle #, recording the original result, spindle and speed. If the reading is over 90, retest using a lower speed or higher spindle #, recording the original result, spindle and speed.
9. Start the motor and then release the clutch. Run the viscometer for 15 seconds and then repeat steps 7 and 8 to take and record a second consecutive reading. Successive measurements must agree within 5%.
10. Determine the viscosity in cps by using the correct factor found on the factor finder for the instrument or see attached Factor Finder.

$$\text{Average Reading}=(\text{Reading 1}+\text{Reading 2})\div 2$$

$$\text{Viscosity,cps}=(\text{Average Reading})\times(\text{Factor})$$

11. Record the viscosity, the temperature of the sample, the spindle and speed that was used.

Digital Viscometer Models

1. Level the instrument using the bubble indicator.
2. Turn on the power switch.
3. Auto-Zero the instrument.
4. Transfer the sample into the specified size beaker and adjust the temperature to that called for in the BOQ. If a temperature is not specified, test at 25° C.±0.5° C.
5. Place the spindle into the sample and attach the spindle to the viscometer.
6. Adjust the height until the fluid level is at the immersion groove cut in the spindle shaft.
7. Set the spindle information on the instrument. For the specific number see the Spindle Entry Code Table.
8. Set the speed at the correct rpm.
9. Turn the motor on.
10. Run the viscometer until the reading stabilizes, typically 1 min unless otherwise stated in the BOQ.
11. Press the CPS button on the instrument for the viscosity in centipoise, cps.

Note: Some digital models display the viscosity on the instrument without pressing a button.

If the display reads "EEE" or the torque reading is greater than 90, the sample reading is over range. Retest using a lower speed or higher spindle #, recording the original viscosity, spindle and speed. If the display reads "---", the torque reading is less than 10 or the low light is lit up, the sample reading is under range. Retest using a higher speed or lower spindle #, recording the original viscosity, spindle and speed.
12. Record the viscosity, the temperature of the sample, the spindle and speed that was used.

Conditions:

RVT—500 cps standard: spindle 2 @ 50 rpm, 25° C., acceptance: (450-550 cps)

5000 cps standard: spindle 4 @ 20 rpm, 25° C., acceptance: (4600-5400 cps)

LVT—50 cps standard: spindle 1 @ 60 rpm, 25° C., acceptance: (40-60 cps)

100 cps standard: spindle 1 @ 30 rpm, 25° C., acceptance: (80-120 cps)

500 cps standard: spindle 2 @ 30 rpm, 25$^{e}$C, acceptance: (450-550 cps)

For the 50 cps standard, if the CofA value varies from 50 by greater than 2.5, the acceptance range may be adjusted accordingly.

For the 100 cps standard, if the CofA value varies from 100 by greater than 5 the acceptance range may be adjusted accordingly.

For the 500 cps standard, if the CofA value varies from 500 by greater than 10 the acceptance range may be adjusted accordingly.

For the 5000 cps standard, if the CofA value varies from 5000 by greater than 50, the acceptance range may be adjusted accordingly.

Method % RSD=2.91 for a 500 cps standard @ 50 rpm.

Performance: % RSD=2.61 for a 5000 cps standard @ 5 rpm.

The relative standard deviations were determined by measuring the two standards on 10 different days.

TABLE 8

| Description | Formula O Wgt. % | Formula P Wgt. % | Formula Q Wgt. % | Formula R Wgt. % |
|---|---|---|---|---|
| Water Zeolite Softened | 49.00 | 48.78 | 47.73 | 46.56 |
| Citric Acid, TAN - 50% | 0.38 | 0.37 | 0.26 | 0.30 |
| Sodium Hydroxide - 50% | 0.00 | 0.00 | 0.00 | 0.00 |
| Sodium Chloride: FCC Gran | 0.00 | 0.00 | 0.00 | 0.00 |
| Sodium Xylene Sulfonate - 40% | 0.00 | 0.00 | 0.00 | 0.00 |
| Lutensol XP-80 | 0.49 | 1.00 | 2.00 | 2.98 |
| Propylene Glycol, TECH | 2.98 | 2.99 | 2.99 | 2.98 |
| Sodium Laur Ether Ethox Sulfate - 60% (SLES) | 7.93 | 7.98 | 7.96 | 7.93 |
| Sodium C14-C16 Olefin Sulfonate - 40% (AOS) | 22.29 | 22.41 | 22.39 | 22.31 |
| Lauryl Dimethylamine Oxide - 30% (AO) | 15.85 | 15.54 | 15.52 | 15.86 |
| PEI Ethoxylate | 0.66 | 0.50 | 0.72 | 0.66 |
| Glutaraldehyde - 50% | 0.02 | 0.02 | 0.02 | 0.02 |
| Fragrance | 0.25 | 0.26 | 0.26 | 0.25 |
| Dye | 0.15 | 0.15 | 0.15 | 0.15 |

Table 9 shows the summary of data showing the impact that nonionic surfactant has on viscosity as measured by the preceding. The results from the formulas from tables 5 and 6 are shown graphically in FIG. 2. On can see that the salt component at less than 2 percent resulted in a much less viscous solution.

TABLE 9

| | Weight % Salt and Viscosity Measurements, cPs | | | | | | | | | | | | |
|---|---|---|---|---|---|---|---|---|---|---|---|---|---|
| | 1.0 | 2.0 | 3.0 | 4.0 | 5.0 | 6.0 | 7.0 | 8.0 | 9.0 | 10.0 | 12.0 | 14.0 | 16.0 |
| Formula O (0.50% XP80) | 1121 | 3584 | 1676 | 568 | | | | | | | | | |
| Formula P (1.0% XP80) | 803 | 2304 | 1260 | 524 | | | | | | | | | |
| Formula Q (2.0% XP80) | 323 | 1030 | 1161 | 712 | 422 | 272 | | | | | | | |
| Formula R (3.0% XP80) | 344 | 718 | 672 | 432 | | | | | | | | | |
| Scout CocoDEA Free (0% SXS) | 354 | 6592 | 2204 | 27640 | 18040 | 6872 | 2460 | 1008 | 563 | 397 | 258 | | |
| Scout CocoDEA Free (1.5% SXS) | 142 | 1360 | 7384 | 12990 | 13640 | 11280 | 7328 | 4200 | 241 | 1393 | 528 | 312 | 240 |
| Scout CocoDEA Free (2.5% SXS) | 69 | 294 | 1336 | 3344 | 5280 | 5848 | 4640 | 2992 | 177 | 933 | 362 | 216 | 174 |

Example 2

Foam stability and cleaning test.

The formulation of the invention was tested using the following protocols and compared to standard liquid cleaning compositions which include cocamide DEA. In each test, the compositions of the invention were shown to clean at least as well as the standard DEA containing cleaning compositions.

Foam Stability of Hand Dishwashing Detergents

This test was chosen to evaluate a manual dishwashing detergent for evaluation as a sample Pot and Pan Detergent. The method is a nationally recognized method able to be easily referenced. Per the description on the method, soiled dinner plates are washed by hand in solutions of hand dishwashing detergents under standardized conditions until an end point of near-disappearance of the foam is reached, after which the number of plates washed is compared to the number of plates washed using a standard product.

Testing Conditions Based on the Method

| | |
|---|---|
| Temperature of water | 117° F. |
| Water conditions | 5 grain |
| Test Soil | Test Soil A-Lard, Wesson oil, corn oil, oleic acid, salt, gelatin, flour, water |
| Use concentration tested | 0.1% (per method) |
| Wash Method | Method A (timed method) |

Results—Total plates washed until the endpoint is reached (where half the surface of the wash solution shows a thin layer of foam).

The next test is used to screen manual dish washing detergents for foam height and stability. This procedure applies to any manual dish washing detergent, but can potentially be used to measure the foam height and stability of any detergent or cleaner.

Supplies:

| |
|---|
| Cylinder rotating device |
| Graduated cylinders (250 mL) with rubber stoppers |
| Disposable pipettes |
| Oven, hot plate, and/or water bath |

-continued

| | | |
|---|---|---|
| Test soil | } | Detailed below |
| Test detergents | | |

Test Soil:

When using "Institutional Soil," make new soil at the beginning of each day of testing. The suggested amount of soil to make is 50 grams.

"Institutional Soil" is made in the lab by heating and mixing the following ingredients until a homogeneous mixture is produced. The soil is composed of:

45% Crisco shortening
30% Flour
15% Powdered whole egg
10% Oleic acid

Control:

Scout should be tested as a control at 3 g/L with 5 grain water at room temperature every time detergents are tested. The control chart, found in the Data Recording Template below, should be updated every time the control is run.

Test Detergents:

All liquid manual detergents can either be tested by scaling use concentrations or by testing at 0.4 oz/gal (3 g/L) with 5 grain water at room temperature. The template found below will calculate the amount of detergent to use if testing at use concentrations. For solid detergents, it is more difficult to decide what concentration to use. Liquid and solid detergents can be compared if scaling according to use concentrations.

Test Procedure:

1. Add 40 mL of test detergent to a 250 mL graduated cylinder. Repeat for each detergent to be tested.
2. Allow all cylinders and test solutions to reach room temperature (75° F.). It is important to have them reach this temperature, as warmer solutions will yield higher foam heights.
3. Liquefy soil by placing in an oven or on a hot plate at 200° F. The soil does not need to be hot, just a homogenous liquid. Make sure the soil is uniform every time before adding drops to the cylinders.
4. Stopper all cylinders, place in apparatus, and securely tighten.
5. Rotate cylinders at 30 rpm for 4 minutes (30 rpm corresponds to the black line on the machine). After 4 minutes, record initial foam height (mL of foam). See note at end of test procedure regarding foam height measurements and data recording.
6. Add 2 drops of test soil using a disposable pipette to the center of the cylinder. Avoid letting the soil drip down the sides of the cylinders.
7. Rotate cylinders at 30 rpm for 2 minutes. Record foam height and add 2 more drops of test soil using a disposable pipette.
8. Repeat step 7 until all foam is gone.
9. Perform five replicates of each detergent.

Calculations:

To characterize each detergent's performance by a single number, take the sum of all foam heights and subtract of 40 mL for each reading.

$$\text{Total Foam Height} = \sum\left(\text{Individual Foam Heights}\right) - \left(\text{Number of Foam Heights}\right)\cdot 40\text{ mL}$$

What is claimed:

1. A liquid cleaning composition comprising:

from about 0.01 wt. % to about 3 wt. % of a nonionic surfactant;

from 0.1 wt. % to about 5 wt. % of one or more coupling agents including a protic solvent, an aromatic sulfonate, or mixture thereof;

from 2 wt. % to about 8 wt. % of a neutral salt; and from about 4 wt. % to about 75 wt. % of a foam promotion or stabilizing agent comprising an alkyl dimethyl amine oxide and an olefin sulfonate, wherein the neutral salt includes $Na^+$, $K^+$, $Rb^+$, $Cs^+$, $Mg^{2+}$, $Ca^{2+}$, $Sr^{2+}$, or $Ba^{2+}$ as cation and $Cl^-$, $Br^-$, $I^-$, $ClO_4^-$, $BrO_4^-$, $ClO_3^-$, or $NO_3^-$ as anion; and wherein said composition having less than 0.5 wt. % of cocamide DEA.

2. The liquid cleaning composition of claim 1 wherein said nonionic surfactant is present in an amount of from about 0.01 wt. % to about 2 wt. %.

3. The liquid cleaning composition of claim 1 wherein said nonionic surfactant is a linear or branched alkoxylated alcohol.

4. The liquid cleaning composition of claim 3 wherein said alkoxylated alcohol is an ethylene oxide, propylene oxide alkoxylated alcohol or mixture thereof.

5. The liquid cleaning composition of claim 1 wherein said aromatic sulfonate is an alkyl aryl sulfonate.

6. The liquid cleaning composition of claim 1 wherein said a protic solvent includes one or more of methanol, ethanol, propanol, isopropanol, butanol, isobutanol, ethylene glycol, diethylene glycol, triethylene glycol, propylene glycol, dipropylene glycol, mixed ethylene-propylene glycol ethers, ethylene glycol phenyl ether, butylene glycol, hexylene glycol, and propylene glycol phenyl ether.

7. The liquid cleaning composition of claim 1 said composition having less than 0.05 wt. % of cocamide DEA.

8. The liquid cleaning composition of claim 1 wherein said neutral salt is present in an amount of from about 2 wt. % to 5 wt. %.

9. The liquid cleaning composition of claim 1, said foam promotion or stabilizing agent is from about 10 wt. % to about 25 wt. % of the composition.

10. The liquid cleaning composition of claim 1, wherein said foam promotion or stabilizing agent comprises sodium C14-16 olefin sulfonate and lauryl dimethylamine oxide.

11. The liquid cleaning composition of claim 1 further comprising a PEI polymer.

12. The liquid cleaning composition of claim 11 wherein said PEI polymer is an ethoxylated PEI polymer.

13. A liquid cleaning composition that is cocamide DEA free comprising:

(a) from about 0.01 wt. % to about 3 wt. % of a nonionic surfactant;

(b) from about 0.01 wt. % to about 10 wt. % of an aromatic sulfonate;

(c) from about 0.01 wt. % to about 10 wt. % of a protic solvent;

(d) a neutral salt in an amount of at least 2 wt. %, said composition having a pH of about 7 to about 10; and (e) from about 4 wt. % to about 75 wt. % of a foam promotion or stabilizing agent comprising an alkyl dimethyl amine oxide and an olefin sulfonate, wherein the neutral salt includes $Na^+$, $K^+$, $Rb^+$, $Cs^+$, $Mg^{2+}$, $Ca^{2+}$, $Sr^{2+}$, or $Ba^{2+}$ as cation and $Cl^-$, $Br^-$, $I^-$, $ClO_4^-$, $ClO_3^-$, or $NO_3^-$ as anion.

14. The liquid cleaning composition of claim 13 further comprising an ethoxylated PEI polymer.

15. The liquid cleaning composition of claim 13 said composition having less than 0.05 wt. % of cocamide DEA.

16. The liquid cleaning composition of claim 13, wherein said foam promotion or stabilizing agent comprises sodium C14-16 olefin sulfonate and lauryl dimethylamine oxide.

17. The liquid cleaning composition of claim 13, wherein said foam promotion or stabilizing agent includes lauryl dimethylamine and one or more of sodium C14-16 olefin sulfonate, sodium laurel ether sulfate and alpha olefin sulfonate and alkylbenzene sulfonic acid.

18. The liquid cleaning composition of claim 13, wherein said foam promotion or stabilizing agent is present in an amount of 10 wt. % to about 25 wt. %.

19. The liquid cleaning composition of claim 14 wherein said ethoxylated PEI polymer is present in an amount of from about 0.01 wt. % to about 2.0 wt. %.

20. A method of cleaning dishware and other hard surfaces comprising:

contacting said dishware or hard surface with a liquid cleaning composition of claim 1 and thereafter rinsing the cleaning composition from the dishware or hard surface so that the cleaning composition and any soils or debris are washed away.

* * * * *